US006832549B2

(12) United States Patent
Satoh

(10) Patent No.: US 6,832,549 B2
(45) Date of Patent: Dec. 21, 2004

(54) ROTARY PRINTING PRESS HAVING PRINTING UNITS EACH HAVING PRINTING DEVICES ARRANGED VERTICALLY IN LAYERS

(75) Inventor: Katsumi Satoh, Tokyo (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/704,555

(22) Filed: Nov. 12, 2003

(65) Prior Publication Data

US 2004/0206258 A1 Oct. 21, 2004

(30) Foreign Application Priority Data

Apr. 17, 2003 (JP) ..... P2003-112626

(51) Int. Cl.[7] ..... B41F 13/02

(52) U.S. Cl. ..... 101/228; 101/219; 101/178

(58) Field of Search ..... 101/174, 176, 101/178, 179, 180, 181, 183, 211, 219, 220, 221, 225, 228; 226/108

(56) References Cited

U.S. PATENT DOCUMENTS 4,930,415 A * 6/1990 Hara et al. ..... 101/228

5,413,039 A * 5/1995 Sohma ..... 101/225

FOREIGN PATENT DOCUMENTS

| | | |
|---|---|---|
| JP | 7-73908 | 8/1995 |
| JP | 8-451 | 1/1996 |
| JP | 2577309 | 11/1996 |
| JP | 10-296946 | 11/1998 |

* cited by examiner

*Primary Examiner*—Leslie J. Evanisko
(74) *Attorney, Agent, or Firm*—Westerman, Hattori, Daniels & Adrian, LLP

(57) ABSTRACT

A rotary printing press includes a plurality of printing units, including at least one multiple-printing unit having a plurality of printing devices arranged vertically in layers. A plurality of first web feed units each having a web roll support device are provided for the printing units in one-to-one correspondence. At least one second web feed unit having a web roll support device is provided as a counterpart to the first web feed unit corresponding to the multiple-printing unit. The printing press includes a web roll transport apparatus, which includes a web roll transport path provided in between the first web feed units and the second web feed unit and along the row of printing units, and a web roll transport device traveling along the web roll transport path.

2 Claims, 5 Drawing Sheets

ROTARY PRINTING PRESS HAVING PRINTING UNITS EACH HAVING PRINTING DEVICES ARRANGED VERTICALLY IN LAYERS

BACKGROUND OF THE INVENTION

1. Field of the Invention

The present invention relates to a rotary printing press having a multiple-printing unit which includes printing devices arranged vertically in layers and which can print on a plurality of paper webs.

2. Description of the Related Arts

A conventional multiple-printing unit configured such that a plurality of printing devices are arranged vertically in layers is disclosed in, for example, Japanese Patent Publication (kokoku) No. H07-73908 as a multicolor printing apparatus of small installation area. In conjunction with an increase in multicolor-printed newspaper pages, such a multicolor printing apparatus has come into wide use in the field of newspaper printing.

The printing apparatus disclosed in Japanese Patent Publication (kokoku) No. H07-73908 is configured such that four printing devices are arranged vertically in layers. Each of the four printing devices includes two combinations of a plate cylinder and a blanket cylinder. The two blanket cylinders are disposed in such a manner as to be able to come into contact with each other. Thus, each of the printing devices can simultaneously print images borne on the plate cylinders onto the opposite sides of a paper web via the corresponding blanket surfaces. A paper web is sequentially threaded between the blanket cylinders of the four printing devices, whereby images in four colors are printed in a superposed manner on the opposite sides of the paper web.

The above-mentioned printing apparatus can simultaneously print on two or more paper webs by means of a single multiple-printing unit, for example, as follows. A single paper web is threaded through at least a single printing device of the four printing devices, while another paper web is threaded through at least a single printing device among the remaining printing devices.

Meanwhile, in order to simultaneously print on two or more paper webs by means of a single multiple-printing unit, two or more paper webs must be simultaneously fed to the multiple-printing unit. A rotary printing press-having a structure for such simultaneous feed of paper webs is disclosed in, for example, Japanese Patent Publication (kokoku) No. H08-451, Japanese Patent No. 2577309, and Japanese Patent Application Laid-Open (kokai) No. H10-296946.

Each of the rotary printing presses disclosed in Japanese Patent Publication (kokoku) No. H08-451, Japanese Patent No. 2577309, and Japanese Patent Application Laid-Open (kokai) No. H10-296946 includes a plurality of multiple-printing units, a single folding machine, and a plurality of web feed units. Each of the multiple-printing units is configured such that a plurality of printing devices are arranged vertically in layers. The folding machine is provided at the same level as the multiple-printing units and is adapted to superpose paper webs which have undergone printing in the multiple-printing units, to cut the superposed paper webs, and to fold resultant printed sheets. The web feed units are provided underneath the multiple-printing units and the folding machine in a number of at least two times the number of multiple-printing units. Two or more paper webs are fed to each of the multiple-printing units, whereby each of the multiple-printing units can simultaneously print on the paper webs.

In the rotary printing press disclosed in Japanese Patent Publication (kokoku) No. H08-451, a web roll support apparatus includes a web feed unit capable of supporting a web roll such that the axis of the web roll is in parallel with a row of multiple-printing units. Also, structures each having two mutually adjacent web feed units corresponding to a single multiple-printing unit are arranged along the row of multiple-printing units.

In the rotary printing press disclosed in Japanese Patent No. 2577309, a web roll support apparatus includes a web feed unit capable of supporting a web roll such that the axis of the web roll is perpendicular to a row of multiple-printing units. Also, structures each having two vertically arranged web feed units corresponding to a single multiple-printing unit are arranged along the row of multiple-printing units.

Japanese Patent Application Laid-Open (kokai) No. H10-296946 does not specifically illustrate a web feed unit of the disclosed rotary printing press. However, FIG. 1 of the publication shows a web roll support apparatus similar to that of the rotary printing press disclosed in Japanese Patent No. 2577309.

In the rotary printing press disclosed in Japanese Patent Publication (kokoku) No. H08-451, a web roll transport path for a web roll transport device for transporting a web roll to be supported by the web roll support apparatus must be provided for each of the two web feed units corresponding to a single multiple-printing unit. In order to provide web roll transport paths at the opposite sides of a row of structures each having two mutually adjacent web feed units, the corresponding planar spaces are required. Therefore, a large planar installation space is required. Additionally, two rows of web roll transport path mechanisms are required. Thus, equipment cost and maintenance cost increase.

In the rotary printing press disclosed in Japanese Patent No. 2577309, the web roll transport path for transporting a web roll to be supported by the web roll support apparatus must be provided for each structure having two vertically arranged web feed units corresponding to a single multiple-printing unit. Alternatively, a single web roll transport path must be provided for every two adjacent structures. Additionally, at least a single web roll transport path into which these web roll transport paths merge must be provided. Thus, the web roll transport path configuration is complicated, thereby increasing equipment cost and maintenance cost.

In view of similarity in the structure of the web roll support apparatus, it cannot be denied that the rotary printing press disclosed in Japanese Patent Application Laid-Open (kokai) No. H10-296946 involves a problem similar to that involved in the rotary printing press disclosed in Japanese Patent No. 2577309.

As mentioned previously, a multiple-printing unit having printing devices arranged vertically in layers originally uses different inks for the individual printing devices, thereby performing multicolor printing by use of as many inks as printing devices arranged vertically in layers. Therefore, it is highly improbable that a rotary printing press having a plurality of multiple-printing units is operated in such a manner that printing operation is performed, while a plurality of paper webs are threaded through all of the multiple-printing units.

Therefore, in the case of the rotary printing apparatus disclosed in Japanese Patent Publication (kokoku) No. H08-

451, Japanese Patent No. 2577309, and Japanese Patent Application Laid-Open (kokai) No. H10-296946, which are configured such that two web feed units are provided for each of the multiple-printing units, one or more web feed units become idle during printing. Provision of such web feed units is wasteful, and even such idle web feed units require maintenance, thereby incurring additional maintenance materials and labor.

SUMMARY OF THE INVENTION

An object of the present invention is to provide a rotary printing press in which a plurality of printing units including at least one multiple-printing unit having a plurality of printing devices arranged vertically in layers with plate cylinders of the printing devices arranged in parallel with one another are arranged in a row and which includes, in addition to a first web feed unit, a second web feed unit corresponding to the multiple-printing unit so as to allow the multiple-printing unit to print on a plurality of paper webs, wherein a web roll transport path for feeding a web roll to each of the two web feed units corresponding to a single multiple-printing unit is provided in a minimal planar space in a simple, shortest-route arrangement involving low equipment and maintenance costs.

Another object of the present invention is to provide a rotary printing press in which the web roll transport path is provided in a minimal planar space in a simple, shortest-route arrangement, which can avoid the wasteful provision of second web feed units, in one-to-one correspondence, for all of the multiple-printing units, and which can feed paper webs from the first and second web feed units to a desired multiple-printing unit so as to perform printing on both the paper webs.

A rotary printing press according to the present invention comprises at least one folding unit, and a plurality of printing units arranged in a row together with the folding unit. The printing unit includes at least one multiple-printing unit having a plurality of printing devices arranged vertically in layers with printing cylinders of the printing devices arranged in parallel with one another. The printing press comprises a plurality of first web feed units provided for the printing units in one-to-one correspondence, and at least one second web feed unit provided in such a manner as to form a counterpart to the first web feed unit corresponding to the multiple-printing unit. Each of the first and second web feed units includes at least one web roll support device capable of supporting a web roll with an axis of the web roll extending in parallel with the row of printing units. The printing press further comprises a web roll transport apparatus, which comprises a web roll transport path provided in between the first web feed units and the second web feed unit and along the row of printing units, and a web roll transport device traveling along the web roll transport path. A plurality of web roll exchange stations are provided for the first web feed units and the second web feed unit in one-to-one correspondence and in such a manner as to face the web roll transport path.

According to the above configuration, the web roll transport path for feeding a web roll to each of the two web feed units corresponding to a single multiple-printing unit can be provided in a minimal planar space in a simple, shortest-route arrangement. Thus, as compared with a conventional similar rotary printing press, equipment and maintenance costs of the web roll transport path can be reduced.

When the printing units include a plurality of multiple-printing units, preferably, the second web feed unit is provided in such a manner as to be movable along a web feed unit travel path provided in parallel with the web roll transport path and in such a manner as to be able to be stopped and positioned at predetermined stop positions corresponding to the multiple-printing units, and the web roll exchange station for the second web feed unit is provided at each of the stop positions.

According to the above configuration, in individual printing operations, a multiple-printing unit for printing on two paper webs that requires the second web feed unit is selected according to the pattern of superposition of printed paper webs, and the second web feed unit can be moved to the position corresponding to the multiple-printing unit that requires the second web feed unit. Thus, the above configuration can avoid the wasteful provision in one-to-one correspondence of second web feed units for all of the multiple-printing units as well as the wasteful provision of a special threading path for superposing printed paper webs in a required order, thereby enhancing work efficiency through simplification of threading and reducing the burden of maintenance work for the threading path.

In the rotary printing press having the above-described structure, before printing is started, a multiple-printing unit (s) for printing on a single paper web and a multiple-printing unit(s) for printing on two paper webs are determined, and threading for these multiple-printing units is performed as follows. In the multiple-printing unit for printing on a single paper web, a paper web from the first web feed unit is sequentially threaded through required printing devices among those arranged vertically in layers. In the multiple-printing unit for printing on two paper webs, paper webs from the first and second web feed units are sequentially threaded through required printing devices among those arranged vertically in layers. Subsequently, the paper webs are further threaded up to a folding unit such that the paper webs are superposed in a required order before reaching the folding unit. After completion of threading, the rotary printing press is operated, thereby producing a printed material consisting of printed sheets which are printed by the corresponding printing units and superposed in a required order.

In supply of a web roll to each web feed unit, a web roll is loaded onto the web roll transport device. Then, the loaded web roll transport device is caused to travel along the web roll transport path, provided on one side of the first web feed units to extend along the row of printing units, to a corresponding web roll exchange station provided in such a manner as to face the web roll transport path. In the web roll exchange station, the web roll is transferred from the web roll transport device to the web roll support device of the web feed unit to thereby be supported by the web roll support device.

In the case where the second web feed unit is movable along the web feed unit travel path, first, the second web feed unit is moved along the web feed unit travel path provided in parallel with the web roll transport path and is then stopped and positioned at a stop position corresponding to a multiple-printing unit which is adapted to print on two paper webs and is preselected in view of superposition of printed paper webs.

Subsequently, a paper web from the first web feed unit is threaded through a multiple-printing unit for printing on a single paper web in such a manner as to be sequentially threaded through required printing devices among those arranged vertically in layers. Also, paper webs from the first and second web feed units are threaded through a multiple-printing unit for printing on two paper webs in such a manner as to be sequentially threaded through required printing devices among those arranged vertically in layers. Then, the paper webs are further threaded up to the folding unit such that the paper webs are superposed in a required order before reaching the folding unit. After completion of threading, the rotary printing press is operated, thereby producing a printed material consisting of printed sheets which are printed by the corresponding printing units and superposed in a required order.

In supply of a web roll to each web feed unit, a web roll is loaded onto the web roll transport device. Then, the loaded web roll transport device is caused to travel along the web roll transport path, provided on one side of the first web feed units to extend along the row of printing units and along side portions, to a corresponding web roll exchange station provided in such a manner as to face the web roll transport path. In the web roll exchange station, the web roll is transferred from the web roll transport device to the web roll support device of the web feed unit to thereby be supported by the web roll support device.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Rotary printing presses according to embodiments of the present invention, each including printing units each having printing devices arranged vertically in layers, will next be described in detail with reference to the drawings.

Figure 1:
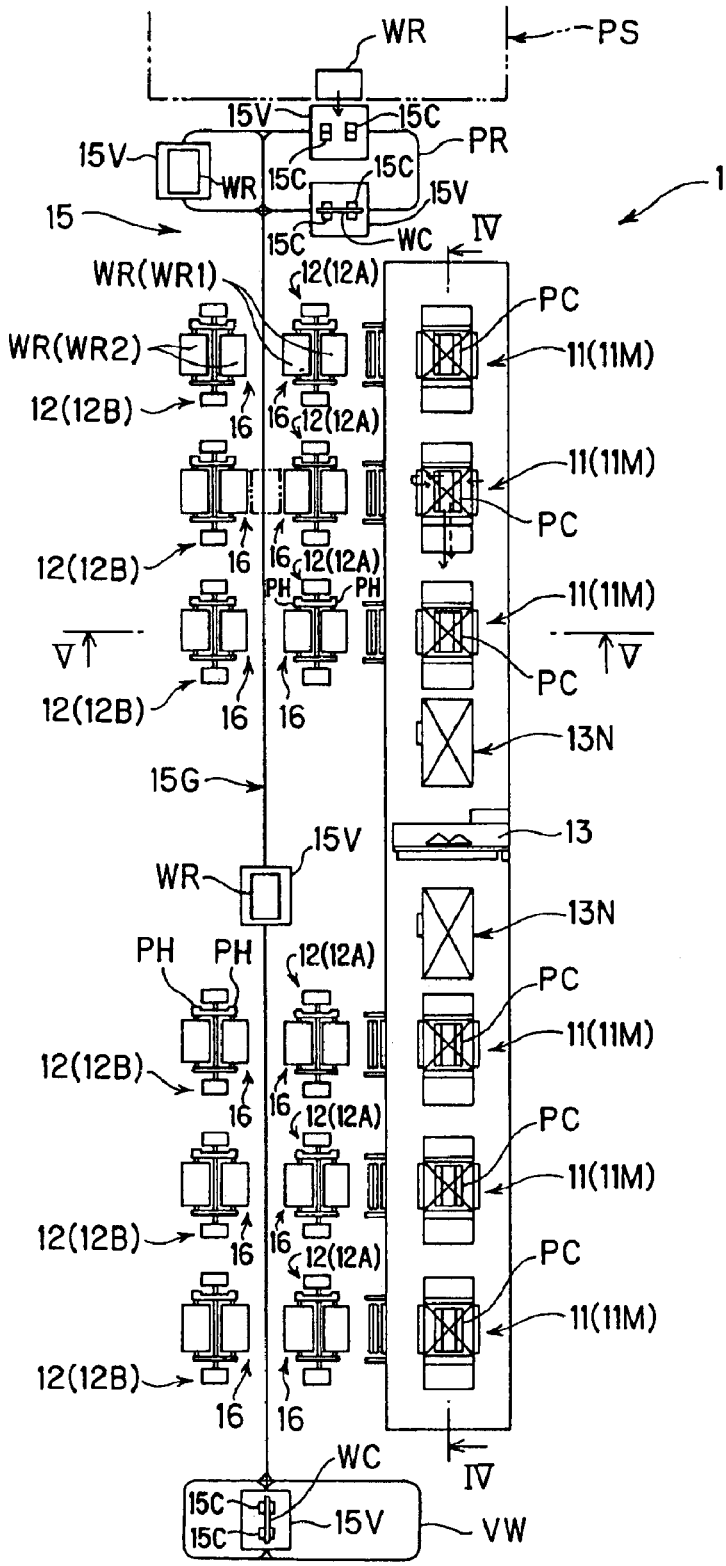
FIG. 1 is a plan view of a rotary printing press according to a first embodiment of the present invention.
Figure 2:
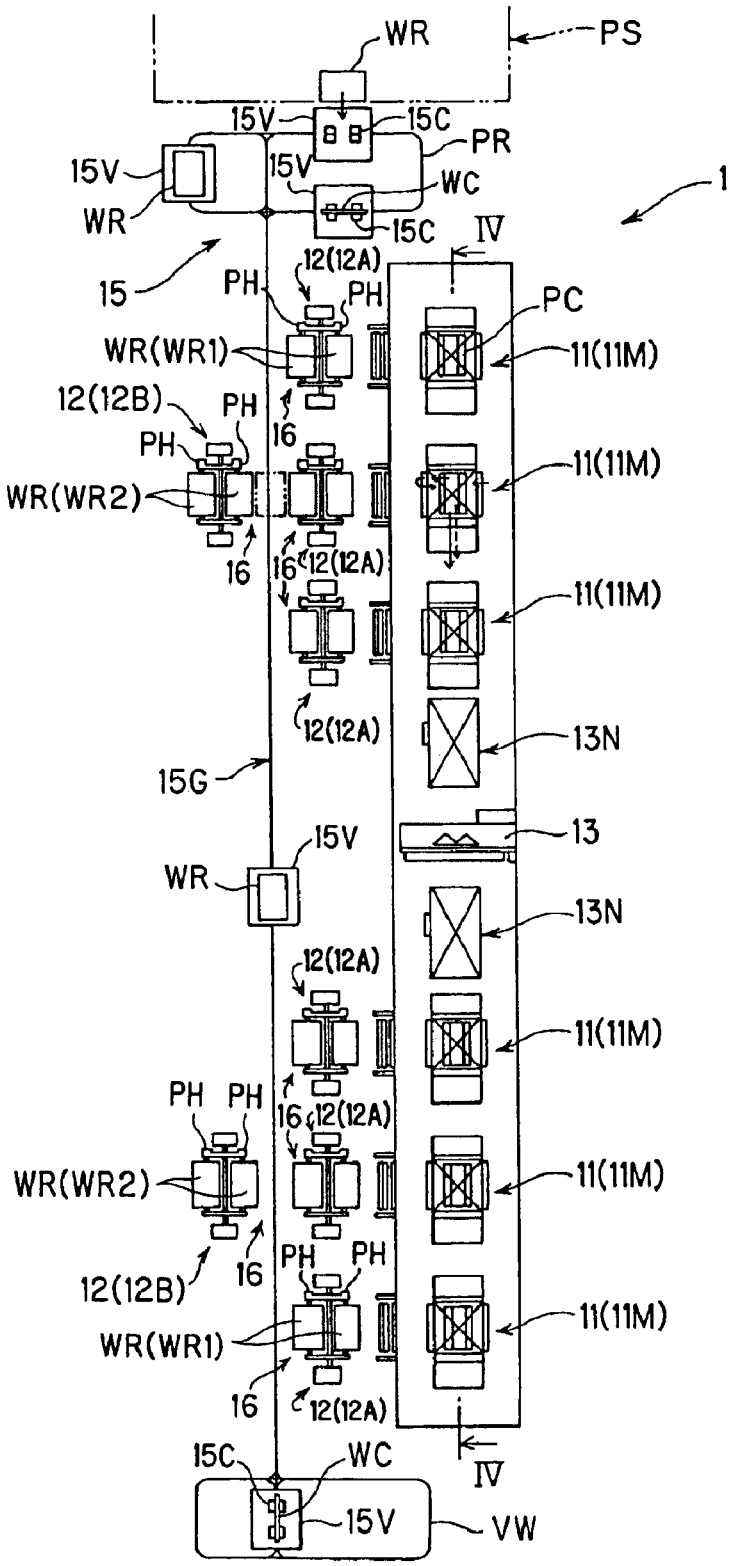
FIG. 2 is a plan view of a rotary printing press according to a second embodiment of the present invention.
Figure 3:
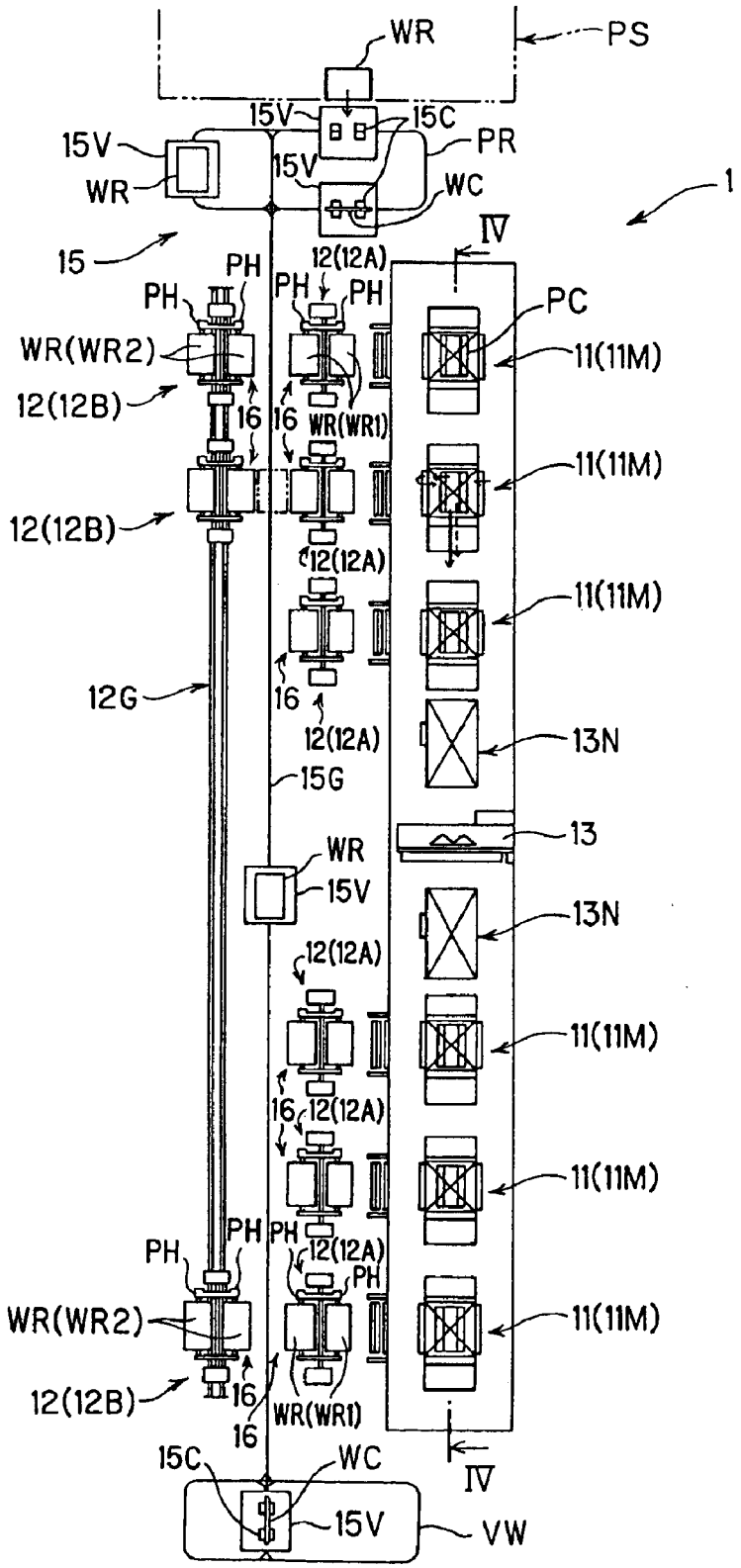
FIG. 3 is a plan view of a rotary printing press according to a third embodiment of the present invention.

In FIG. 1 (showing a first embodiment of the present invention), FIG. 2 (showing a second embodiment of the present invention), and FIG. 3 (showing a third embodiment of the present invention), each rotary printing press 1 includes printing units 11, first web feed units 12A, second web feed units 12B, a folding unit 13, a web roll transport apparatus 15, and web roll exchange stations 16.

A plurality of (six in the illustrated embodiments) printing units 11 are arranged in a row directed in the axial direction of their printing cylinders PC. Each of the printing units 11 is a multiple-printing unit 11M having a plurality (four in the illustrated embodiments) of printing devices arranged vertically in layers. The plurality of printing devices of each multiple-printing unit 11M are arranged vertically in layers such that the printing cylinders PC of the printing devices PA are arranged in parallel with each other and in parallel with the row of the printing units 11.

All of the printing units 11 are not necessarily multiple-printing units 1M, but at least one printing unit 11 is a multiple-printing unit 1M. Also, no limitation is imposed on the number of printing devices PA of the multiple-printing unit 1M, so long as the multiple-printing unit 11M has two or more printing devices PA.

In order to feed a first paper web W1 to the printing units 11, as many first web feed units 12A as the printing units 11 are arranged in a row so as to make one-to-one correspondence to the printing units 11. Each of the first web feed units 12A includes at least a single web roll support device RH capable of supporting a first web roll WR1, which serves as a source of the first paper web W1. The first web feed units 12A are arranged such that the axis of the web roll WR1 supported by the web roll support device RH of each of the first web feed units 12A is in parallel with the row of the printing units 11 and such that the row of the first web feed units 12A is in parallel with the row of the printing units 11.

A single or a plurality of second web feed units 12B are provided on the opposite side of the row of the first web feed units 12A from the row of the printing units 11 in such a manner as to make one-to-one correspondence to selected first web feed units 12A. The number of second web feed units 12B ranges from one to the number of the multiple-printing units 11M (see the first embodiment in FIG. 1). In order to allow passage of the web roll transport apparatus 15, the second web feed units 12B are positioned such that the minimum distance between the axis of the web roll support device PH of the first web feed unit 12A and the axis of the web roll support device PH of the second web feed unit 12B is a predetermined distance greater than two times the maximum diameter of the web roll WR to be used in the rotary printing press (see FIG. 5).

In order to feed a second paper web W2 to the corresponding multiple-printing unit 1M, each of the second web feed units 12B includes at least a single web roll support device PH capable of supporting a second web roll WR2, which serves as a source of the second paper web W2. The second web feed units 12B are arranged such that the axis of the web roll WR2 supported by the web roll support device PH of each of the second web feed units 12B is in parallel with the row of the printing units 11 and such that the row of the second web feed units 12B is in parallel with the row of the printing units 11.

As in the case of the third embodiment shown in FIG. 3, a single or a plurality of (three in the illustrated embodiment) second web feed units 12B may be provided in such a manner as to be movable along a web feed unit travel path 12G provided in parallel with the row of the printing units 11 and the row of the first web feed units 12A.

Stop positions of the second web feed unit 12B are determined along the web feed unit travel path 12G in such a manner as to correspond to the multiple-printing units 11M. At each of the stop positions, a stop-positioning device (not shown) is provided so as to position the second web feed unit 12B in cooperation with the second web feed unit 12B. At each of the stop positions, the second web feed unit 12B forms a counterpart to the first web feed unit 12A corresponding to the multiple-printing unit 11M.

Figure 4:
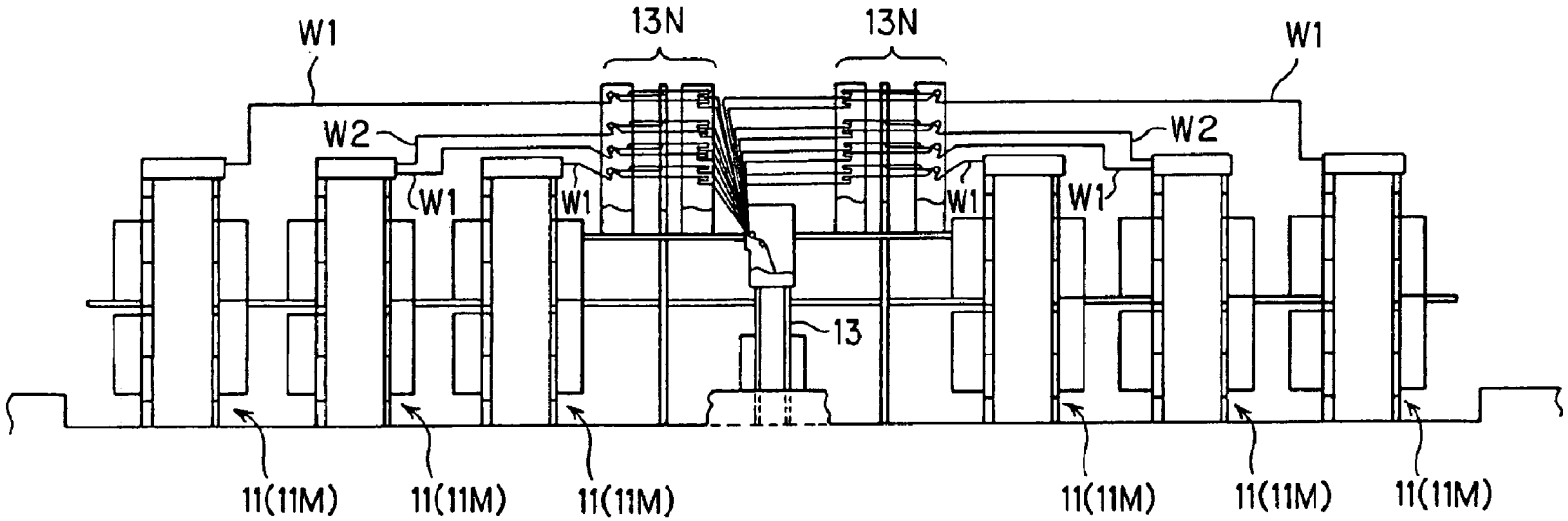
FIG. 4 is a view as viewed in the direction of arrows IV—IV in FIGS. 1, 2, and 3.

The folding unit 13 is provided in the row of the printing units 11 at an appropriate position in juxtaposition to the printing units 11. In the illustrated embodiment, the folding unit 13 is provided such that the axis of an unillustrated rotary cylinder of the folding unit 13 is in parallel with the axis of the printing cylinder PC of the printing units 11 and in such a manner as to be located at a central portion of the row of the printing units 11. As shown in FIG. 4, the folding unit 13 includes threading paths, or so-called nests 13N, extending between the folding unit 13 and the printing units 11 and adapted to superpose the printed paper webs W in a required order.

The web roll transport apparatus 15 includes a web roll transport path 15G, which is provided in between the row of the first web feed units 12A and the second web feed units 12B in parallel with the row of the printing units 11; and a web roll transport device 15V capable of traveling along the web roll transport path 15G. A web roll reception path PR is provided at one end of the web roll transport path 15G adjacently to a paper storage PS for storing web rolls. As the need arises, a turnout VW for the web roll transport device 15V is provided at the other end of the web roll transport path 15G.

The web roll transport device 15V includes a web roll support section 15C capable of supporting the web roll WR and moving vertically while carrying the web roll WR, and is adapted to travel along the web roll transport path 15G to the web roll exchange station 16 while the web roll support section 15C is loaded with the web roll WR.

The web toll transport device 15V includes a web roll; core receiving section (not shown) for receiving from the web roll support device PH a web roll core WC that remains after consumption of the paper web of the web roll WR. Before a new web roll WR is transferred to the web roll support device PH, the web roll core receiving section receives the web roll core WC that remains on the web roll support device PH after consumption of the paper web of the web roll WR. Then, the new web roll WR is transferred to the web roll support device PH. Subsequently, the web roll core WC received by the web roll core receiving section is transferred to the web roll support section 15C so as to be brought back to the web roll reception path PR.

The web roll exchange stations 16 are provided in such a manner as to face the web roll transport path 15G of the web roll transport apparatus 15 and in one-to-one correspondence to the first and second web feed units 12A and 12B. Thus, the number of the web roll exchange stations 16 is at least the total number of the first and second web feed units 12A and 12B.

In the third embodiment shown in FIG. 3, the web roll exchange stations 16 for the second web feed units 12B are provided at the stop positions where the second web feed unit 12B moving along the web feed unit travel path 12G stops.

Each of the web roll exchange stations 16 is configured in such a manner as to allow the following movement of the web roll transport device 15V that is loaded with the web roll WR such that the axis of the web roll WR is in parallel with the row of the printing units 11. While staying at the position of facing the first and second web feed units 12A and 12B, the web roll transport device 15V moves in the direction perpendicular to the web roll transport path 15G so as to approach the first web feed unit 12A or the second web feed unit 12B to such an extent as to enable transfer of the web roll WR to the web roll support device PH, and so as to return to the web roll transport path 15G.

Figure 5:
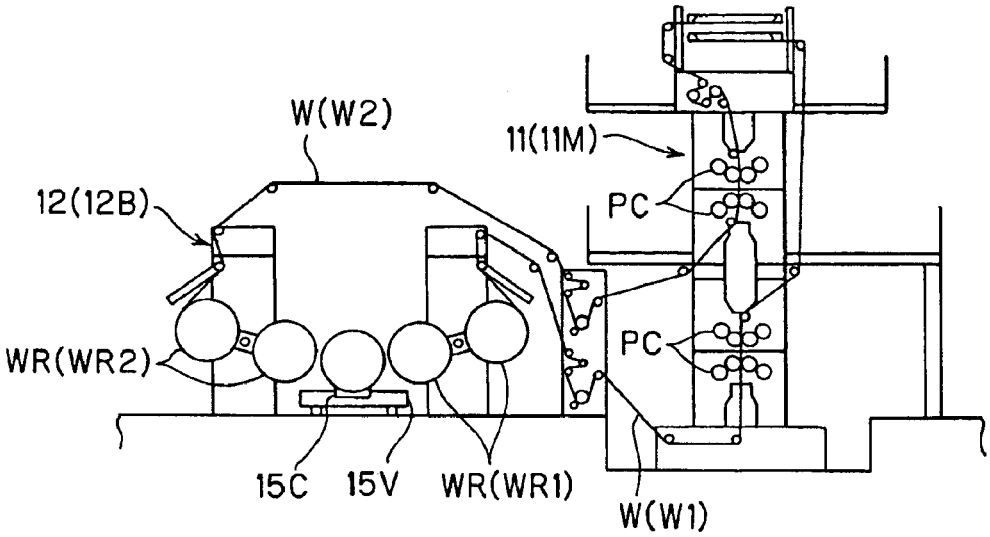
FIG. 5 is a view as viewed in the direction of arrows. V—V in FIGS. 1 and 2.
Figure 6:
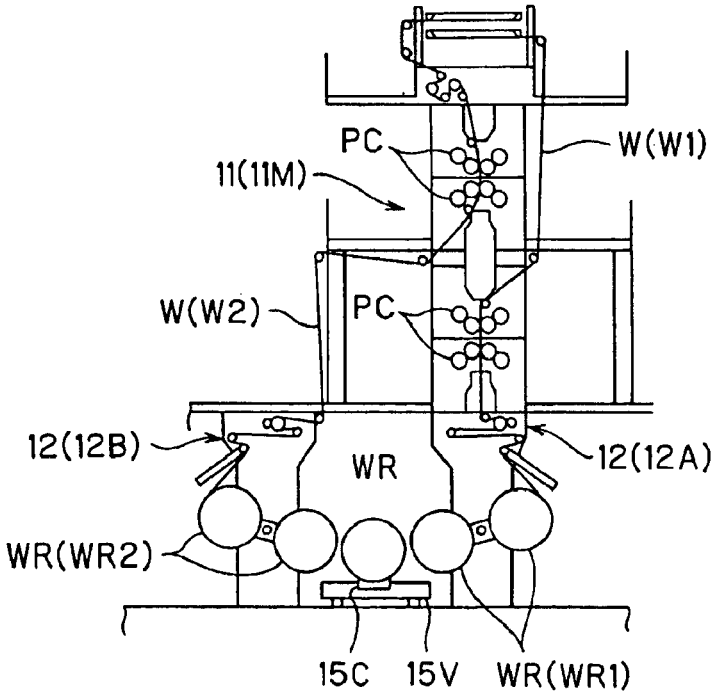
FIG. 6 is a view of a rotary printing press according to a fourth embodiment of the present invention as viewed in the same manner as in FIG. 5.

The rotary printing press 1 of the fourth embodiment shown in FIG. 6 differs from the rotary printing presses 1 of the first to third embodiments shown in FIG. 5 in that the first web feed units 12A are provided under the corresponding printing units 11, while the second web feed units 12B are provided in parallel with the row of the printing units 11 and the row of the first web feed units 12A.

In order to allow passage of the web roll transport apparatus 15, the second web feed units 12B are positioned such that the minimum distance between the axis of the web roll support device PH of the first web feed unit 12A and the axis of the web roll support device PH of the second web feed unit 12B is a predetermined distance greater than two times the maximum diameter of the web roll WR to be used in the rotary printing press (see FIG. 6).

Other features of installation configuration may be similar to those of the first to third embodiments.

As described above with reference to the drawings illustrating the embodiments, in order to allow common use between the first web feed units 12A and the second web feed units 12B, the web roll transport path 15G, along which the web roll transport device 15V travels so as to supply the web roll WR to the web feed units 12, is linearly provided along the row of the printing units 11 and in between the first web feed units 12A and the second web feed units 12B, thereby minimizing a necessary planar equipment installation space and simplifying equipment structure.

Furthermore, in the case of the rotary printing press 1 of the third embodiment, in individual printing operations, the second web feed units 12B can be moved to the positions corresponding to the multiple-printing units 11M that require the second web feed unit 12B, thereby minimizing the required number of the second web feed units 12B.

Next, operation will be described for each of the above-described configurations.

First, before start of printing by the rotary printing press 1, the multiple-printing units 11M for printing on the first paper web W1 only and the multiple-printing units for printing on the first and second paper webs W1 and W2 are determined.

In the rotary printing press 1 of the first embodiment, the multiple-printing units 11M for printing on the first and second paper webs W1 and W2 are arbitrarily selected from among six multiple-printing units 11M.

In the rotary printing press 1 of the second embodiment, the multiple-printing units 11M provided with the second web feed unit 12B are selected as the multiple-printing units 1M for printing on the first and second paper webs W1 and W2.

In the rotary printing press 1 of the third embodiment, the second web feed unit 12B is moved along the web feed unit travel path 12G, which is provided in parallel with the web roll transport path PR, and is stopped at a predetermined stop position, which is located on the web feed unit travel path 12G and corresponds to the multiple-printing unit 11M for printing on the first and second paper webs W1 and W2. At the stop position, the second web feed unit 12B is positioned by means of an unillustrated stop-positioning device.

In each of the multiple-printing units 11M for printing on the first paper web W1 only, the first paper Web W1 is drawn from the first web roll WR1 supported by the first web feed unit 12A corresponding to this multiple-printing unit 11M and is sequentially threaded through the printing devices PA of the multiple-printing unit 1M. In each of the multiple-printing units 11M for printing on the first and second paper webs W1 and W2, the first paper web W1 is drawn from the first web roll WR1 supported by the first web feed unit 12A corresponding to this multiple-printing unit 11M and is sequentially threaded through required printing devices PA among those of the multiple-printing unit 1M.

In the rotary printing presses 1 of the first and second embodiments, the second paper web W2 is drawn from the second paper roll WR2 supported by the second web feed unit 12B corresponding to each of the selected multiple-printing units 11M and is sequentially threaded through required printing devices PA among those of the multiple-printing unit 11M.

In the rotary printing press 1 of the third embodiment, the second paper web W2 is drawn from the second paper roll WR2 supported by the second web feed unit 12B positioned at the stop position corresponding to each of the selected multiple-printing units 1M, and is sequentially threaded through required printing devices PA among those of the multiple-printing unit 1M.

Next, the nest 13N threads up to the folding unit 13 the paper webs W that have passed through the printing units 11, while changing the vertical order of the paper webs W to a required order and superposing the paper webs W in the required order. After completion of threading, the rotary printing press 1 is operated, thereby producing a printed material consisting of printed sheets that are printed by the corresponding printing units 11 and superposed in the required order.

Before start of printing or upon complete consumption of the paper web W of the web roll WR in the course of printing, the web roll WR is supplied to relevant web feed units 12. The web roll WR is supplied to the web feed units 12 as follows. The web roll transport device 15V of the web roll transport apparatus 15 is moved to the web roll reception path PR adjacent to the paper storage PS. The web roll WR is loaded onto the web roll support section 15C of the web roll transport device 15V. Then, the web roll transport device 15V is caused to travel along the web roll transport path 15G, which is provided in between the first web feed units 12A and the second web feed units 12B along the row of the printing units 11, to each of the web roll exchange stations 16 corresponding to the web feed units 12 and facing the web roll transport path 15G.

In the rotary printing press 1 of the third embodiment, the web roll transport device 15V is moved to the web roll exchange stations 16 provided in correspondence to the web feed units 12 or to the web roll exchange stations 16 provided in correspondence to stop positions where the second web feed units 12B are positioned.

When the web roll transport device 15V arrives at the web roll exchange station 16, the unillustrated web roll core receiving section of the web roll transport device 15V receives, if present, the web roll core WC that remains, after consumption of the paper web W of the web roll WR, on the web roll support device PH to which a new web roll WR is to be supplied. Then, the new web roll WR is supplied to the web roll support device PH. In supply of the new web roll WR, the web roll support section 15C is raised so as to align a central portion of the new web roll WR with the center of the web roll support device PH. Subsequently, the web roll support device PH is caused to hold the new web roll WR at its central portion from opposite sides.

After supply of the new web roll WR to the web roll support device PH, the web roil transport device 15V lowers the web roll support section 15C, moves the received web roll core WC from the web roll core receiving section to the web roll support section 15C, and returns to the web roll reception path PR. When the web roll transport device 15V is to return to the web roll reception path PR, if the web feed unit 12 that is located farther from the web roll reception path PR than the web roll transport device 15V requests supply of a new web roll WR, the web roll transport device 15V moves to the turnout VW and stays there for the time being, thereby avoiding hindrance to supply of a new web roll WR to the web feed unit 12.

Obviously, numerous modifications and variations of the present invention are possible in light of the above teachings. It is therefore to be understood that within the scope of the appended claims, the present invention may be practiced otherwise than as specifically described herein.

What is claimed is:

1. A rotary printing press comprising:

at least one folding unit;

a plurality of printing units arranged in a row together with the folding unit, the printing units including at least one multiple-printing unit having a plurality of printing devices arranged vertically in layers with printing cylinders of the printing devices arranged in parallel with one another;

a plurality of first web feed units provided for the printing units in one-to-one correspondence, each of the first web feed units including at least one web roll support device capable of supporting a web roll with an axis of the web roll extending in parallel with the row of printing units;

at least one second web feed unit provided in such a manner as to form a counterpart to the first web feed unit corresponding to the multiple-printing unit, the second web feed unit including at least one web roll support device capable of supporting a web roll with an axis of the web roll extending in parallel with the row of printing units;

a web roll transport apparatus comprising a web roll transport path provided in between the first web feed units and the second web feed unit and along the row of printing units, and a web roll transport device traveling along the web roll transport path; and a plurality of web roll exchange stations provided for the first web feed units and the second web feed unit in one-to-one correspondence and in such a manner as to face the web roll transport path.

2. A rotary printing press according to claim 1, wherein the printing units include a plurality of multiple-printing units, and wherein the second web feed unit is provided in such a manner as to be movable along a web feed unit travel path provided in parallel with the web roll transport path and in such a manner as to be able to be stopped and positioned at predetermined stop positions corresponding to the multiple-printing units, and the web roll exchange station for the second web feed unit is provided at each of the stop positions.

* * * * *